US010287772B1

(12) United States Patent
Winn

(10) Patent No.: US 10,287,772 B1
(45) **Date of Patent: *May 14, 2019**

(54) CLIP AND METHOD OF USING THE CLIP TO MOUNT A FURRING CHANNEL ON AN ELONGATED LOAD BEARING MEMBER OF A DRYWALL GRID SYSTEM

(71) Applicant: Brandon C. Winn, Robbinsville, NJ (US)

(72) Inventor: Brandon C. Winn, Robbinsville, NJ (US)

(73) Assignees: Brandon C. Winn, Robbinsville, NJ (US); Ken Huber, Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/170,497

(22) Filed: Oct. 25, 2018

Related U.S. Application Data

(63) Continuation of application No. 15/883,282, filed on Jan. 30, 2018, now Pat. No. 10,145,104.

(51) Int. Cl.
*E04B 2/74* (2006.01)
*E04B 2/78* (2006.01)

(52) U.S. Cl.
CPC ..... *E04B 2/7863* (2013.01); *E04B 2/7457* (2013.01); *E04B 2002/7464* (2013.01)

(58) Field of Classification Search
CPC ..... E04B 2/7863; E04B 2/78; E04B 2/7457; E04B 2002/7464
USPC ..... 52/489.1
See application file for complete search history.

(56) References Cited

U.S. PATENT DOCUMENTS 3,608,857 A * 9/1971 Hibbeler ..... E04B 9/18 248/317
4,157,000 A * 6/1979 Sutter ..... E04B 9/24 52/506.07
4,245,446 A 1/1981 Judkins
4,266,384 A * 5/1981 Orals ..... E04B 9/22 52/407.1
4,377,060 A * 3/1983 Ragland ..... E04B 2/7409 52/361
4,463,537 A * 8/1984 Rodriquez ..... E04B 9/225 52/506.07
4,476,658 A * 10/1984 Johnstone ..... E04D 3/366 52/395
4,479,341 A * 10/1984 Schuplin ..... E04B 9/127 52/506.07

(Continued)

*Primary Examiner* — Paola Agudelo
(74) *Attorney, Agent, or Firm* — Caesar Rivise, PC

(57) ABSTRACT

Disclosed is a clip and method of mounting a furring channel to a load bearing member of a drywall grid system. The load bearing member includes an elongated web having an enlarged upper portion and a lower portion from which a pair of coplanar flanges projecting outward. The clip includes a bottom wall and an end wall from which two hanger hooks project upward. Each hanger hook includes a folded over portion configured to snap-fit and entrap a portion of the enlarged upper portion of the load bearing member, with the bottom wall being disposed on one of flanges of the load bearing member. A second clip is mounted on the load bearing member in a similar manner so that its bottom wall is disposed on the other of the flanges of the load bearing member, and with the hanger hooks of the two clips being interposed. A respective furring channel is mounted on each of the clip to be supported thereby.

17 Claims, 2 Drawing Sheets

(56) References Cited

U.S. PATENT DOCUMENTS

| | | | | |
|---|---|---|---|---|
| 4,553,365 | A | 11/1985 | Bechstein | |
| 4,649,684 | A * | 3/1987 | Petree | E04D 3/366 52/395 |
| 4,781,005 | A | 11/1988 | Rijnders | |
| 4,884,383 | A | 12/1989 | Rijnders | |
| 5,425,209 | A * | 6/1995 | Funaki | E04D 3/3602 52/309.1 |
| 5,893,250 | A * | 4/1999 | Benvenuto | E04B 9/0478 52/506.06 |
| 7,552,567 | B2 * | 6/2009 | Ingratta | E04B 9/06 52/506.05 |
| 8,549,810 | B1 | 10/2013 | Norton et al. | |
| 8,887,464 | B1 * | 11/2014 | Smith, Jr. | E04D 3/28 52/336 |
| 9,926,707 | B1 * | 3/2018 | Knight, Jr. | E04F 13/12 |
| 10,060,460 | B1 * | 8/2018 | Winn | F16B 7/0473 |
| 10,145,104 | B1 | 12/2018 | Winn | |
| 2005/0155317 | A1 * | 7/2005 | Frezza | E04B 2/7457 52/745.19 |
| 2005/0252158 | A1 * | 11/2005 | Tamaya | B60R 11/0217 52/716.6 |
| 2012/0102865 | A1 * | 5/2012 | Baxter | E04B 9/225 52/506.06 |
| 2017/0044767 | A1 * | 2/2017 | Gloftis | E04B 9/183 |

* cited by examiner

CLIP AND METHOD OF USING THE CLIP TO MOUNT A FURRING CHANNEL ON AN ELONGATED LOAD BEARING MEMBER OF A DRYWALL GRID SYSTEM

CROSS-REFERENCE TO RELATED APPLICATIONS

This application is a continuation of application Ser. No. 15/883,282, filed on Jan. 30, 2018, entitled Clip and Method of Using the Clip to Mount a Furring Channel on an Elongated Load Bearing Member of a Drywall Grid System, which application is assigned to the same assignees as the subject invention and whose disclosure is specifically incorporated by reference herein.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

FIELD OF THE INVENTION

The disclosed invention relates to clips and more particularly to clips for suspending furring channels from load-bearing members, e.g., drywall grid systems.

BACKGROUND OF THE INVENTION

Various types of furring channels are disclosed in the prior art and are commercially available for securing a structural element, e.g., plywood, composite-board, sheetrock, etc., to it to form a ceiling for a building. Such furring channels are configured so that they are mountable on a load bearing member, such as a drywall grid system. Drywall grid systems are available from various sources, such as Armstrong® Ceiling Solutions, Certainteed Ceilings (St. Gobain), United States Gypsum, Chicago Metallic (Rockfon) and others. Such grid systems typically include main tees or beams and cross tees which are interconnected to one another and to which the structural element is secured to form the ceiling. Instead of utilizing a grid system comprising main beams and cross tees, one can utilize only main tees or beams to mount furring channels thereon, whereupon the structural elements can be secured to the furring channels.

One common type of furring channel which is suitable for mounting on the main tee or beam of a drywall grid system is a U-shaped member having bottom wall and a pair of spaced-apart sidewalls projecting upward from the bottom wall. Each of the sidewalls terminates at a somewhat narrow inwardly directed, downward angled flange having a free edge. The free edges of the inwardly directed flanges are spaced apart by a width that is less than the width separating the sidewalls. In order to connect or mount such a furring channel on the main tee of drywall grid system, a clip or some other connector must be provided. While there are prior art clips and other connectors for that purpose they leave much to be desired. Accordingly, a need exists for a clip which improves upon the prior art.

The subject invention addresses that need by providing a clip and method of mounting the same on a load bearing member, e.g., a main tee or beam, of a drywall grid system, and once so mounted enables one to readily mount a furring channel thereon. Moreover, the clip is simple in construction, easy to install and effective in operation.

SUMMARY OF THE INVENTION

One aspect of this invention is a clip for mounting a furring channel to a load bearing member of a drywall grid system. The load bearing member comprises an intermediate elongated web section having a lower end from which a pair of coplanar flanges extends in opposite directions from each other and an upper end in the form of an elongated enlarged width section. The clip comprises a base and an end wall. The base has a pair of sides from which respective ones of a first sidewall and a second sidewall project upward. The base includes a first portion projecting inward from the first sidewall and a second portion projecting inward from the second sidewall. The end wall projects upward from an end of the base between the sidewalls. The end wall comprises a first hangar hook and a second hanger hook. The first hanger hook is located closely adjacent the first sidewall. The first hanger hook comprises a folded over top portion having a downwardly extending wall terminating in an inwardly projecting flange. The second hangar hook is spaced from the first sidewall by a first distance and spaced from the second sidewall by a second distance. The second hanger hook comprises a folded over top portion having a downwardly extending wall terminating in an inwardly projecting flange.

The clip is configured for mounting on the load bearing member, whereupon a portion of the base of the clip is disposed on a first one of the pair of coplanar flanges of the load bearing member, with the folded over top portion of the first hanger hook encompassing a first portion of the elongated enlarged width section, with the inwardly projecting flange of the first hanger hook engaging a first portion of an undersurface of the elongated enlarged width section, with the folded over top portion of the second hanger hook encompassing a second portion of the elongated enlarged width section, and with the inwardly projecting flange of the second hanger hook engaging a second portion of an undersurface of the elongated enlarged width section.

In accordance with one preferred aspect of the clip of this invention the inwardly projecting flange of each of the first and second hanger hooks is configured to be moved from a closed state to an open state to receive a respective portion of the elongated enlarged width section within the folded over top portion and thereafter automatically move to the closed state to trap the elongated enlarged width section therein.

In accordance with another preferred aspect of the clip of this invention the elongated enlarged width section of the load bearing member has a top wall. The first and second hangar hooks project upward from the base wall. The folded over top portion of the each of the first and second hanger hooks includes a top wall configured to engage a respective portion of the top wall of the load bearing member when the elongated enlarged width section is trapped within the folded over top portions of the first and second hanger hooks.

In accordance with another preferred aspect of the clip of this invention each of the first and second sidewalls includes a top edge. The furring channel comprises a hollow member that has a bottom wall and a pair of sidewalls projecting upward from the bottom wall, with each of the sidewalls of the furring channel terminating at an inwardly directed flange. The top edge of each of the first and second sidewalls is configured to have a respective one of the inwardly directed flanges of the furring channel disposed thereon to support the furring channel on the clip.

In accordance with another preferred aspect of the clip of this invention the clip is a first clip configured to be used with a second clip on the load bearing member. The second clip is identical to the first clip. The first clip is configured to be mounted on the load bearing member with the first portion of the base of the first clip disposed on a first one of the pair of coplanar flanges and the second portion of the base of the first clip also disposed on the first one of the pair of coplanar flanges, and wherein the second clip is configured to be mounted on the load bearing member with the first portion of the base of the second clip disposed on a second one of the pair of coplanar flanges and the second portion of the base of the second clip also disposed on the second one of the pair of coplanar flanges, whereupon the sidewalls of the first clip and the second clip are axially aligned.

In accordance with another preferred aspect of the clip of this invention the second hanger hook of the second clip is interposed between the first and second hanger hooks of the first clip, and wherein the second hanger hook of the first clip is interposed between the first and second hanger hooks of the second clip.

Another aspect of this invention is a method of mounting a furring channel on a load bearing member of a drywall grid system. The load bearing member includes an intermediate elongated web section that has a lower end from which a pair of coplanar flanges extends in opposite directions from each other and an upper end in the form of an elongated enlarged width section. The method comprises providing a clip that comprises a base and an end wall. The base has a pair of sides from which respective ones of a first sidewall and a second sidewall project upward. The base includes a first portion projecting inward from the first sidewall and a second portion projecting inward from the second sidewall. The end wall projects upward from an end of the base between the sidewalls. The clip also includes a first hangar hook located closely adjacent the first sidewall, a second hangar hook spaced from the first sidewall by a first distance and spaced from the second sidewall by a second distance. The first hanger hook comprises a folded over top portion that has a downwardly extending wall terminating in an inwardly projecting flange. The second hanger hook comprises a folded over top portion that has a downwardly extending wall terminating in an inwardly projecting flange. The clip is disposed on the load bearing member, whereupon the first portion of the base is disposed on a first one of the pair of coplanar flanges and the second portion of the base also disposed on the first one of the pair of coplanar flanges, with the folded over top portion of first hanger hook encompassing a first portion the elongated enlarged width section, with the inwardly projecting flange of the first hanger hook engaging a first portion of an undersurface of the elongated enlarged width section, with the folded over top portion of the second hanger hook encompassing a second portion of the elongated enlarged width section, and with the inwardly projecting flange of the second hanger hook engaging a second portion of an undersurface of the elongated enlarged width section.

In accordance with one preferred aspect of the method of this invention the method additionally comprises moving the inwardly projecting flange of each of the first and second hanger hooks from a closed state to an open state to receive respective portions of the elongated enlarged width section within respective ones of the folded over top portions of the first and second hanger hooks, whereupon the inwardly projecting flange of each of the first and second hanger hooks automatically moves to the closed state to trap the elongated enlarged width member within the folded over top portions of the first and second hanger hooks.

In accordance with another preferred aspect of the method of this invention the clip is a first clip and wherein the method additionally comprises providing a second clip constructed identically to the first clip, wherein the first clip is mounted on the load bearing member with the first portion of the base of the first clip disposed on a first one of the pair of coplanar flanges and the second portion of the base of the first clip also disposed on the first one of the pair of coplanar flanges, and wherein the second clip is mounted on the load bearing member with the first portion of the base of the second clip disposed on a second one of the pair of coplanar flanges and the second portion of the base of the second clip also disposed on the second one of the pair of coplanar flanges, whereupon the sidewalls of said first clip and the second clip are axially aligned.

In accordance with another preferred aspect of the method of this invention the second hanger hook of the second clip is interposed between the first and second hanger hooks of the first clip, and wherein the second hanger hook of the first clip is interposed between the first and second hanger hooks of the second clip.

In accordance with another preferred aspect of the method of this invention the furring channel comprises a hollow member that has a bottom wall and a pair of sidewalls projecting upward from the bottom wall, with each of the sidewalls of the furring channel terminating at an inwardly directed flange. The furring channel has an open end. The method additionally comprises sliding the open end of the furring channel onto the clip, whereupon the inwardly directed flanges of the furring channel are disposed on the sidewalls of the clip.

In accordance with another preferred aspect of the method of this invention the method comprises mounting two furring channels on the load bearing member. Each of the furring channels comprises a hollow member that has a bottom wall and a pair of sidewalls projecting upward from the bottom wall, with each of the sidewalls of each furring channel terminating at an inwardly directed flange. Each of the furring channels has an open end. The method additionally comprises sliding the open end of one of the furring channels onto the one of the clips, whereupon the inwardly directed flanges of the one of the furring channels are disposed on the sidewalls of the one of the clips, and sliding the open end of the other of the furring channels onto the other of the clips, whereupon the inwardly directed flanges of the other of the furring channels are disposed on the sidewalls of the other of the clips.

BRIEF DESCRIPTION OF THE DRAWING FIGURES

DETAILED DESCRIPTION OF THE PREFERRED EMBODIMENTS

Figure 1:
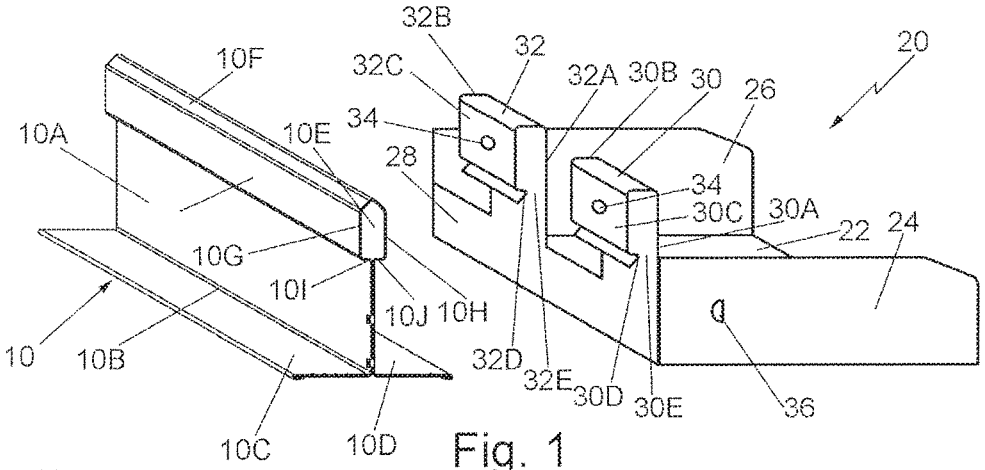
FIG. 1 is an isometric view of one exemplary clip constructed in accordance with this invention shown in position for mounting on a load bearing member, e.g., a drywall main tee or beam, thereon, whereupon a furring channel can be mounted on the clip.

Referring now to the drawings wherein like characters refer to like parts there is shown at 20 in FIG. 1 one exemplary embodiment of a clip constructed in accordance with this invention for mounting on a load bearing member, e.g., a drywall grid main tee or beam 10, to mount and support a furring channel 100 (FIGS. 8 and 9) on the clip, whereupon a drywall, sheet rock, or some other ceiling panel (not shown) can be mounted on the furring channel 100.

Before describing the clip 20, a brief description of the exemplary load bearing member, i.e., the drywall main tee or beam 10 shown in FIG. 1, is in order. The drywall main tee or beam 10 is a conventional load bearing component sold by various vendors, such as those mentioned above and others. Thus, the main tee or beam 10 basically comprises an elongated member, formed of any suitably strong material, e.g., steel, aluminum, etc., and which is of a generally inverted T-shape in cross section. The main tee or beam 10 includes an intermediate elongated web section 10A having a lower end 10B from which a pair of coplanar flanges 10C and 10D extends in opposite directions to each other. The upper end of the elongated web section 10A is in the form of an enlarged width section 10E. In the exemplary embodiment shown the enlarged width section is a hollow tubular member having an inverted V-shaped top wall 10F, a pair of downwardly projecting planar sidewalls 10G and 10H, and a pair of inwardly extending bottom walls 10J and 10I. The inwardly extending bottom walls 10I and 10J merge together at the web section 10A and form respective undersurfaces of the enlarged width section 10E.

Figure 8:
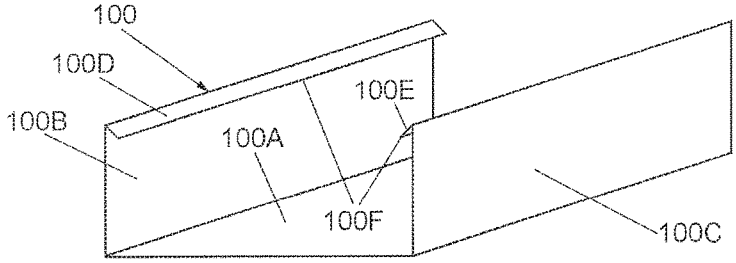
FIG. 8 is an isometric view of one exemplary, in this case conventional, furring channel which can be mounted on a clip like that of FIG. 1.

The furring channel 100 is of a conventional construction and is exemplary of various prior art furring channels that can be used with the subject invention. To that end, as best seen in FIG. 8 the furring channel 100 is an elongated member formed of any suitable strong material, e.g., steel, and which is of a generally U-shaped cross-section. The channel includes a bottom wall 100A and a pair of spaced-apart sidewalls 100B and 100C projecting upward from the bottom wall. The sidewall 100B and terminates at a somewhat narrow flange 100D which is inwardly directed and angled downward toward the bottom wall 100A. In a similar manner the sidewall 100C terminates at a somewhat narrow flange 100E which is inwardly directed and angled downward toward the bottom wall 100A. Each flange 100D and 100E includes a free edge 100F. The free edges 100F of the flanges 100D and 100E are spaced apart by a distance that is less than the space separating the sidewalls 10B and 10C.

Turning now to FIGS. 1-5 the details of the clip 20 will now be described. As can be seen the clip 20 is a somewhat tray-shaped member having a bottom or base wall 22, a first side wall 24, a second side wall 26, and an end wall 28. Preferably the clip is an integral member which is formed as a unit, e.g., bent or otherwise shaped, from a blank sheet of any suitably strong material, e.g., steel. Alternatively, the clip can be molded as an integral unit of any suitable strong material.

In any case, the base wall 22 is a planar member having a pair of sides at which respective ones of the first and second side walls are located and from which the sidewalls project upward. The end wall 28 comprises a generally planar panel projecting upward from an end of the base wall 22 and between the sidewalls 24 and 26. The planar panel making up the end wall 28 includes a first upwardly projecting hangar hook 30 located immediately adjacent the first sidewall 24 and a second upwardly projecting hangar hook 32 spaced from the first hanger hook. The second upwardly projecting hanger hook 32 is of the same width as the first hanger hook 30 and is spaced from the first hanger hook by the width of the first hanger hook. Moreover, the second hanger hook is spaced from the sidewall 26 by the width of the first hanger hook. This arrangement enables two clips to be mounted on respective flanges of the load bearing member so that their hanger hooks are interleaved and their sidewalls are axially aligned, as will be described later.

Figure 2:
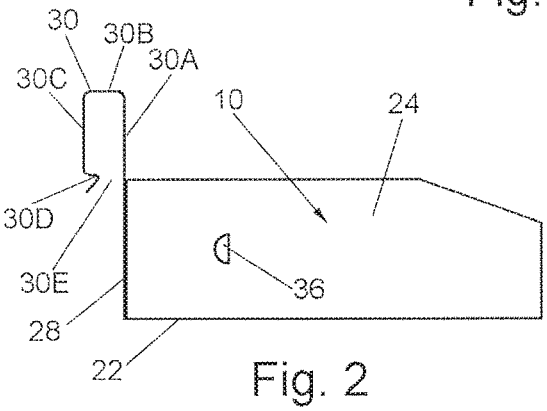
FIG. 2 is a slightly reduced side elevation view of the clip shown in FIG. 1.
Figure 3:
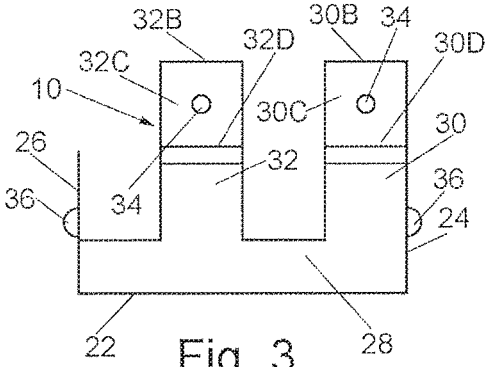
FIG. 3 is a slightly reduced front elevation view of the clip shown in FIG. 1.
Figure 4:
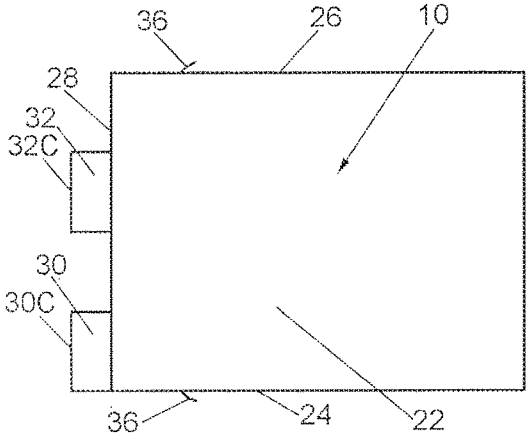
FIG. 4 is a slightly reduced top plan view elevation view of the clip shown in FIG. 1.
Figure 5:
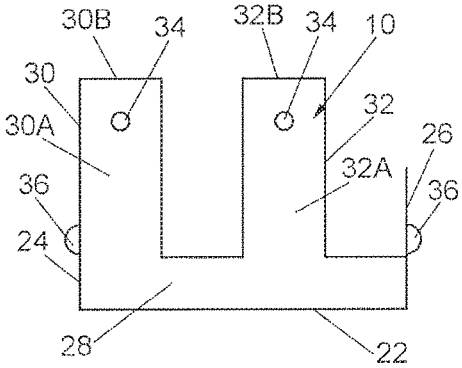
FIG. 5 is a slightly reduced rear elevation view of the clip shown in FIG. 1.

As best seen in FIGS. 1 and 2, the first hanger hook 30 includes a back wall 30A, which is coplanar with the end wall 28, and a folded over top portion comprising a generally planar top wall 30B which terminates in a downwardly projecting front wall 30C. The lower end of the front wall 30C is in the form of an inwardly directed angular flange 30D. The spacing between the inner surface of the back wall 30A and the inner surface of the front wall 30C is just slightly greater than the spacing between the outer surfaces of the sidewalls 10G and 10H of the main tee or beam 10. Moreover, the innermost portion of the flange 30D and the inner surface of the back wall 30 is less than the spacing between the inner surface of the back wall 30A and the inner surface of the front wall 30C. That spacing forms a mouth 30E which is configured to flex open to enable the elongated enlarged width section 10E of the main tee or beam 10 to pass therethrough, as will be described later.

The second hanger hook 32 is constructed identically to the first hanger hook 30 and thus includes a back wall 32A, which is coplanar with the end wall 28, and a folded over top portion comprising a generally planar top wall 32B which terminates in a downwardly projecting front wall 32C. The lower end of the front wall 32C is in the form of an inwardly directed angular flange 32D, which together with the inner surface of the back wall 30A forms the mouth 32E of the hanger hook 32.

The front walls 30C and 32C of the hanger hooks 30 and 32, respectively, each include a hole 34 for the purpose of mechanically fastening the clip to the carrying beam via a screw or any other appropriate fastening device.

Figure 6:
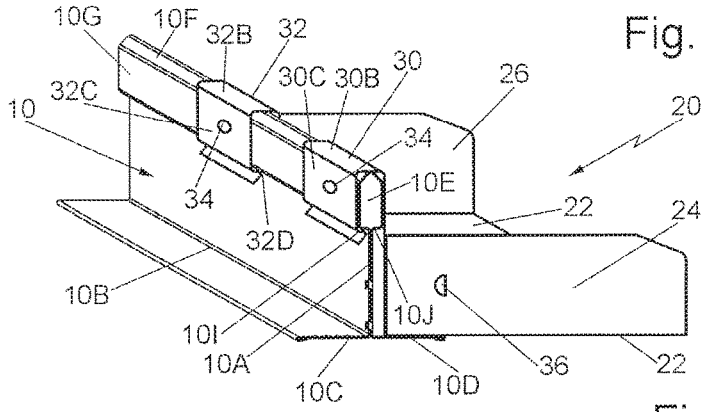
FIG. 6 is an isometric view of the clip of FIG. 1 shown mounted on one flange of the drywall main tee or beam of FIG. 1.

The hanger hooks 30 and 32 are configured to receive respective portions of the enlarged width section 30C of the main tee or beam 10, while the bottom wall 22 of the clip rests on one of the flanges 10C or 10D of the main tee or beam. Thus, in the exemplary view shown in FIG. 6, the clip 20 is oriented so that the enlarged width section 10E of the clip 20 can be inserted through the mouths 30E and 32E of the hanger hooks 30 and 32, respectively, whereupon the apex of the top wall 10F is in engagement with the undersurface of the top walls 30B and 32B of the hanger hooks. Once the enlarged width section 10E is in place within the hanger hooks, as just described, the inherent springiness of the material (e.g., steel) making up the clip 20 will cause the mouths 30E and 32E to snap back to their original state, thereby trapping the enlarged width section 10E of main tee or beam within the folded over portions of those hanger hooks. At the same time the undersurface of the bottom wall 22 of the clip 20 will rest on and be supported by the outwardly projecting flange 10D.

Figure 7:
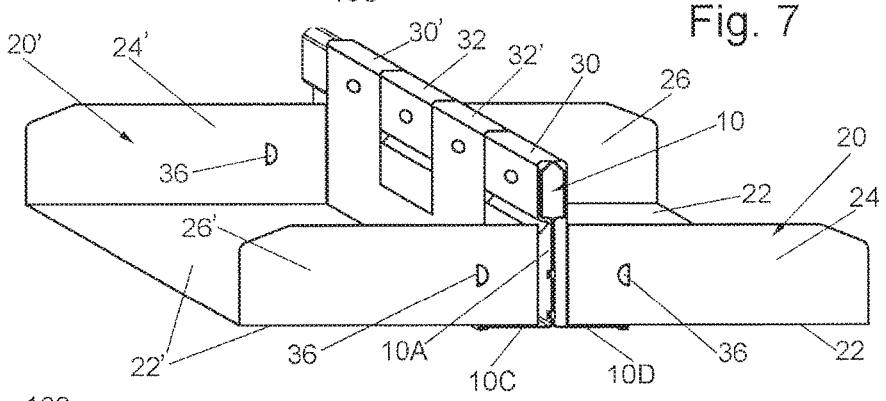
FIG. 7 is an isometric view similar to FIG. 6, but showing two clips like that of FIG. 1 mounted on respective flanges of the drywall main tee or beam shown in FIG. 1 such that the clips are axially aligned perpendicular to the longitudinal axis of the drywall main tee or beam to ready the clips for mounting respective furring channels thereon.

Once the clip 20 has been mounted on the flange 10D of the main tee or beam 10, as just described, another (a second) clip 20' of identical construction to the first clip 20 can be mounted on the opposite flange 10C of the main tee or beam in the same manner as described with reference to the mounting of the first clip 20 on the flange 10D. In particular, as best seen in FIG. 7, when so mounted the second clip 20' is oriented so that its sidewall 26' is coplanar with the sidewall 24 of the first clip and its sidewall 24' is coplanar with the sidewall 26 of the first clip. In that state the hanger hooks will be interleaved. In particular, the hanger hook 32' of the second clip 20' will be located in the space between the hanger hooks 30 and 32 of the first clip 20, and the hanger hook 30' of the second clip 20' will be located in the space between the hanger hook 32 and the sidewall 26 of the first clip 20. Moreover, the undersurface of the bottom wall 22' of the second clip 20' will rest on and be supported by the flange 10C of the main tee or beam 10. With the clips 20 and 20' being mounted on the main tee or beam 10, as just described their sidewalls will be axially aligned with each other. In that state the assembly is now ready to mount the furring channels thereon.

Figure 9:
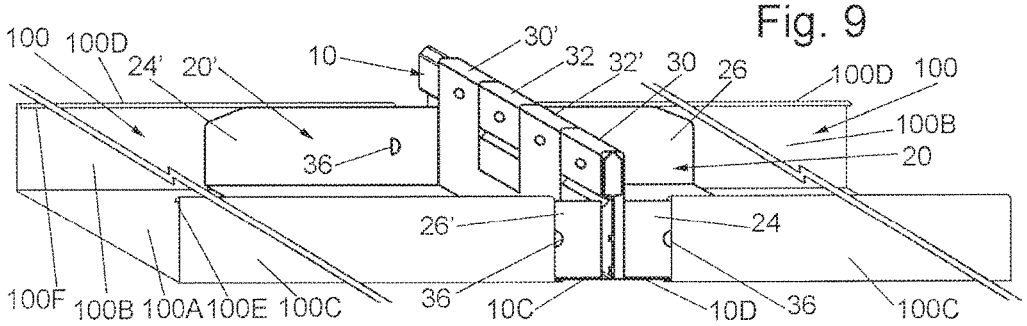
FIG. 9 is a slightly reduced isometric view, similar to FIG. 7, but showing two exemplary furring channels like that of FIG. 8 in the process of being mounted on a pair of clips mounted on the drywall main tee or beam like shown in FIG. 7.

To that end, the mounting of the furring channels 100 on the assembled clips and main tee or beam is shown in FIG. 9 and is accomplished as follows. One end of one furring channel 100 is slid onto the free end of the clip 20, so that the top edge of the sidewall 24 is located immediately below the undersurface of the angular flange 100F, while at the same time the top edge of the sidewall 26 is located immediately below the undersurface of the angular flange 100D, and the undersurface of the bottom wall 22 is disposed on the top surface of the bottom wall 100A. The furring channel 100 can then be slid down the sidewalls 24 and 26 towards the end wall 28 of the clip until the inner end of the furring channel is immediately adjacent that end wall 28. In order to prevent slippage or disconnection of the furring channel on the clip 20, the sidewalls 24 and 26 of the clip 20 each include a slight semi-domed projection or nub 36 bent out of the plane of the sidewall and projecting outward therefrom. These nubs serve to frictionally engage the inner surface of the adjacent sidewall of the furring channel to hold it in place.

As will be appreciated by those skilled in the art once the furring channels are mounted on the clips as just described, conventional ceiling panels, e.g., sheetrock, etc., can be secured to the furring channels to form a ceiling for the structure in which ceiling grid system is located.

It should be pointed out at this juncture that the clip 20 as described above is merely exemplary of various types of clips that can be constructed in accordance with this invention. Thus, various changes can be made to the size and shape of portions of the clips within the context of this invention so long as the clip includes two hanger hooks and adjacent sidewalls so that two clips can be mounted on respective flanges of a main tee or beam, with the hanger hooks interleaved so that the clips are axially aligned with each other. Moreover, while the clips of this invention have been disclosed for use on one particular type of load bearing member, i.e., a main tee or beam of a drywall grid system, they can be used with other types load bearing members, e.g., cross beams, of drywall grid systems, and other load bearing members of a generally inverted T-shaped cross section having an elongated web whose upper end is of an enlarged width section, whether a hollow tubular member or otherwise. So too, the furring channel for mounting on the clip of the subject invention can take various shapes so long as it includes a pair of inwardly directed flanges, under which the portions of sidewalls of the clip can be disposed to support the furring channel on the sidewalls of the clip.

Without further elaboration the foregoing will so fully illustrate my invention that others may, by applying current or future knowledge, adopt the same for use under various conditions of service.

I claim:

1. A clip for mounting a furring channel to a load bearing member of a drywall grid system, the load bearing member comprising an intermediate elongated web section having a lower end from which a pair of coplanar flanges extends in opposite directions from each other and an upper end in the form of an elongated enlarged width section, said clip comprising:

a base having a pair of sides from which respective ones of a first sidewall and a second sidewall project upward, said base including a first portion projecting inward from said first sidewall and a second portion projecting inward from said second sidewall;

an end wall projecting upward from an end of said base between said sidewalls and comprising:

at least one hangar hook comprising a folded over top portion having a downwardly extending wall terminating in a inwardly projecting flange;

said clip being configured for mounting on the load bearing member, whereupon said first portion of said base is disposed on a first one of the pair of coplanar flanges and said second portion of said base also disposed on the first one of the pair of coplanar flanges, with said folded over top portion of said at least one hanger hook encompassing a first portion of the elongated enlarged width section, and with said inwardly projecting flange of said at least one hanger hook engaging a first portion of an undersurface of the elongated enlarged width section.

2. The clip of claim 1, wherein said at least one hanger hook comprises a first hanger hook and a second hanger hook, wherein said first hanger hook is located closely adjacent said first sidewall and comprises a folded over top portion having a downwardly extending wall terminating in a inwardly projecting flange, wherein said second hanger hook is spaced from said first sidewall by a first distance and spaced from said second sidewall by a second distance, said second hanger hook comprising a folded over top portion having a downwardly extending wall terminating in a inwardly projecting flange, and wherein said inwardly projecting flange of each of said first and second hanger hooks is configured to be moved from a closed state to an open state to receive a respective portion of the elongated enlarged width section within said folded over top portion and thereafter automatically move to said closed state to trap said elongated enlarged width section therein.

3. The clip of claim 2, wherein the elongated enlarged width section of the load bearing member has a top wall, wherein said first and second hangar hooks project upward from said base wall, wherein said folded over top portion of said each of said first and second hanger hooks includes a top wall configured to engage a respective portion of the top wall of load bearing member when the elongated hollow enlarged width section is trapped within said folded over top portions of said first and second hanger hooks.

4. The clip of claim 3, wherein each of said first and second sidewalls includes a top edge, and wherein the furring channel comprises a hollow member having a bottom wall and a pair of sidewalls projecting upward from the bottom wall, with each of the sidewalls of the furring channel terminating at an inwardly directed flange, said top edge of each of said first and second sidewalls being configured to have a respective one of the inwardly directed flanges of the furring channel disposed thereon.

5. The clip of claim 1, wherein each of said first and second sidewalls includes a top edge, and wherein the furring channel comprises a hollow member having a bottom wall and a pair of sidewalls projecting upward from the bottom wall, with each of the sidewalls of the furring channel terminating at an inwardly directed flange, said top edge of each of said first and second sidewalls being configured to have a respective one of the inwardly directed flanges of the furring channel disposed thereon.

6. The clip of claim 2, wherein each of said first and second sidewalls includes a top edge, and wherein the furring channel comprises a hollow member having a bottom wall and a pair of sidewalls projecting upward from the bottom wall, with each of the sidewalls of the furring channel terminating at an inwardly directed flange, said top edge of each of said first and second sidewalls being configured to have a respective one of the inwardly directed flanges of the furring channel disposed thereon.

7. The clip of claim 1, wherein said clip is a first clip configured to be used with a second clip, said second clip being identical to said first clip, whereupon first clip is configured to be mounted on the load bearing member with said first portion of said base of said first clip disposed on a first one of the pair of coplanar flanges and said second portion of said base of said first clip also disposed on the first one of the pair of coplanar flanges, and wherein said second clip is configured to be mounted on the load bearing member with said first portion of said base of said second clip disposed on a second one of the pair of coplanar flanges and said second portion of said base of said second clip also disposed on the second one of the pair of coplanar flanges, whereupon said sidewalls of said first clip and said second clip are axially aligned.

8. The clip of claim 2, wherein said clip is a first clip configured to be used with a second clip, said second clip being identical to said first clip, whereupon first clip is configured to be mounted on the load bearing member with said first portion of said base of said first clip disposed on a first one of the pair of coplanar flanges and said second portion of said base of said first clip also disposed on the first one of the pair of coplanar flanges, wherein said second clip is configured to be mounted on the load bearing member with said first portion of said base of said second clip disposed on a second one of the pair of coplanar flanges and said second portion of said base of said second clip also disposed on the second one of the pair of coplanar flanges, whereupon said sidewalls of said first clip and said second clip are axially aligned, and wherein said second hanger hook of said second clip is interposed between said first and second hanger hooks of said first clip, and with said second hanger hook of said first clip being interposed between said first and second hanger hooks of said second clip.

9. The clip of claim 2, wherein said clip is a first clip configured to be used with a second clip, said second clip being identical to said first clip, whereupon first clip is configured to be mounted on the load bearing member with said first portion of said base of said first clip disposed on a first one of the pair of coplanar flanges and said second portion of said base of said first clip also disposed on the first one of the pair of coplanar flanges, and wherein said second clip is configured to be mounted on the load bearing member with said first portion of said base of said second clip disposed on a second one of the pair of coplanar flanges and said second portion of said base of said second clip also disposed on the second one of the pair of coplanar flanges, whereupon said sidewalls of said first clip and said second clip are axially aligned.

10. The clip of claim 9, wherein said second hanger hook of said second clip is interposed between said first and second hanger hooks of said first clip, and with said second hanger hook of said first clip being interposed between said first and second hanger hooks of said second clip.

11. A method of mounting a furring channel on a load bearing member of a drywall grid system, said load bearing member including an intermediate elongated web section having a lower end from which a pair of coplanar flanges extends in opposite directions from each other and an upper end in the form of an elongated enlarged width section, said method comprising:

providing a clip comprising a base having a pair of sides from which respective ones of a first sidewall and a second sidewall project upward, said base including a first portion projecting inward from said first sidewall and a second portion projecting inward from said second sidewall, an end wall projecting upward from an end of said base between said sidewalls and comprising at least one hangar hook located closely adjacent said first sidewall and comprising a folded over top portion having a downwardly extending wall terminating in a inwardly projecting flange; and disposing said clip on said load bearing member, whereupon said first portion of said base is disposed on a first one of the pair of coplanar flanges and said second portion of said base is also disposed on the first one of the pair of coplanar flanges, with said folded over top portion of said at least one hanger hook encompassing a first portion the elongated enlarged width section, with said inwardly projecting flange of said at least one hanger hook engaging a first portion of an undersurface of said elongated enlarged width section.

12. The method of claim 11, wherein said at least one hanger hook comprises a first hanger hook and a second hanger hook, said first hangar hook being located closely adjacent said first sidewall and comprising a folded over top portion having a downwardly extending wall terminating in a inwardly projecting flange, said second hangar hook being spaced from said first sidewall by a first distance and spaced from said second sidewall by a second distance, said second hanger hook comprising a folded over top portion having a downwardly extending wall terminating in a inwardly projecting flange, and wherein said method additionally comprises moving said inwardly projecting flange of each of said first and second hanger hooks from a closed state to an open state to receive respective portions of said elongated enlarged width section within respective ones of said folded over top portions of said first and second hanger hooks, whereupon said inwardly projecting flange of each of said first and second hanger hooks automatically moves to said closed state to trap said elongated enlarged width section within said folded over top portions of said first and second hanger hooks.

13. The method of claim 12, wherein said furring channel comprises a hollow member having a bottom wall and a pair of sidewalls projecting upward from the bottom wall, with each of the sidewalls of the furring channel terminating at an inwardly directed flange, said furring channel having an open end, and wherein said method additionally comprises:

sliding said open end of said furring channel onto said clip, whereupon said inwardly directed flanges of said furring channel are disposed on said sidewalls of said clip.

14. The method of claim 11, wherein said furring channel comprises a hollow member having a bottom wall and a pair of sidewalls projecting upward from the bottom wall, with each of the sidewalls of the furring channel terminating at an inwardly directed flange, said furring channel having an open end, and wherein said method additionally comprises:

sliding said open end of said furring channel onto said clip, whereupon said inwardly directed flanges of said furring channel are disposed on said sidewalls of said clip.

15. The method of claim 11, wherein said clip is a first clip and wherein said method additionally comprising providing a second clip constructed identically to said first clip, wherein said first clip is mounted on the load bearing member with said first portion of said base of said first clip disposed on a first one of the pair of coplanar flanges and said second portion of said base of said first clip also disposed on the first one of the pair of coplanar flanges, and wherein said second clip is mounted on the load bearing member with said first portion of said base of said second clip disposed on a second one of the pair of coplanar flanges and said second portion of said base of said second clip also disposed on the second one of the pair of coplanar flanges, whereupon said sidewalls of said first clip and said second clip are axially aligned.

16. The method of claim 15, wherein said at least one hanger hook comprises a first hanger hook and a second hanger hook, said first hangar hook being located closely adjacent said first sidewall and comprising a folded over top portion having a downwardly extending wall terminating in a inwardly projecting flange, said second hangar hook being spaced from said first sidewall by a first distance and spaced from said second sidewall by a second distance, said second hanger hook comprising a folded over top portion having a downwardly extending wall terminating in a inwardly projecting flange, and wherein said second hanger hook of said second clip is interposed between said first and second hanger hooks of said first clip, and with said second hanger hook of said first clip being interposed between said first and second hanger hooks of said second clip.

17. The method of claim 16, wherein said method comprises mounting two furring channels on said load bearing member, each of said furring channels comprising a hollow member having a bottom wall and a pair of sidewalls projecting upward from the bottom wall, with each of the sidewalls of each furring channel terminating at an inwardly directed flange, each of said furring channels having an open end, and wherein said method additionally comprises:

sliding said open end of one of said furring channels onto said one of said clips, whereupon said inwardly directed flanges of said one of said furring channel are disposed on said sidewalls of said one of said clips; and sliding said open end of the other of said furring channels onto said other of said clips, whereupon said inwardly directed flanges of said other of said furring channel are disposed on said sidewalls of said other of said clips.

* * * * *